United States Patent [19]

Kiekhaefer

[11] 4,297,097

[45] Oct. 27, 1981

[54] STERN DRIVE MECHANISM

[76] Inventor: Elmer C. Kiekhaefer, 2408 Cypress Gardens Rd., Winter Haven, Fla. 33880

[21] Appl. No.: 880,713

[22] Filed: Feb. 23, 1978

[51] Int. Cl.[3] ..... B60F 3/00

[52] U.S. Cl. ..... 440/59

[58] Field of Search ..... 115/34 R, 35, 37, 41 R, 115/41 HT, 73

[56] References Cited

U.S. PATENT DOCUMENTS

| | | | |
|---|---|---|---|
| Re. 27,826 | 12/1973 | Langley | 115/35 |
| 2,302,795 | 11/1942 | Noble | 115/41 R |
| 2,681,029 | 6/1954 | Canazzi | 115/34 R |
| 2,840,324 | 6/1958 | Smith | 244/52 |
| 2,988,039 | 6/1961 | Nimmo et al. | 115/35 |
| 3,054,376 | 9/1962 | Schneider | 115/35 |
| 3,489,120 | 1/1970 | Strang | 115/35 |
| 3,534,703 | 10/1970 | Ekman | 115/35 |
| 3,626,467 | 12/1971 | Mazziotti | 115/41 HT |
| 3,738,306 | 6/1973 | Pinkerton | 115/34 |
| 3,977,356 | 8/1976 | Kroll | 115/35 |

*Primary Examiner*—Trygve M. Blix
*Assistant Examiner*—Jesus D. Sotelo
*Attorney, Agent, or Firm*—Andrus, Sceales, Starke & Sawall

[57] ABSTRACT

The stern drive installation includes a mounting bracket assembly for securement to the transom of a watercraft. The bracket assembly is provided with a transverse horizontal bore rearwardly of the transom for receiving one end of the horizontal cylindrical portion of the upper housing of the drive unit. A bracket assembly addition is provided with a horizontal bore which rotatably receives the opposite end of the horizontal cylindrical portion of the upper housing and is secured to the bracket assembly. The bracket assembly and the addition thereto serve to rotatably support the drive unit and provide for tilt movement of the unit on a horizontal transverse axis. The lower housing of the drive unit is dirigibly connected to the upper housing for support and to provide for pivotal movement of the lower housing relative to the upper housing to provide for steering control of the watercraft.

13 Claims, 9 Drawing Figures

STERN DRIVE MECHANISM

NATURE AND SUMMARY OF THE INVENTION

This invention relates to a stern drive for watercraft. More specifically, it relates to that form of stern drive wherein the upper gear housing is pivotally carried in the mounting bracket assembly attached to the transom of the watercraft. Such a structure eliminates the need for a yoke or gimbal ring suspension for the drive unit along with the attendant universal connection and the bellows cover therefor in the drive transmission.

According to the invention, the stern drive installation generally includes a mounting bracket assembly and a drive unit with the latter being driven by a drive connection extending through the bracket assembly from an engine mounted inboard of the watercraft. The bracket assembly is secured to the transom of the watercraft and includes a horizontal transverse bore rearwardly of the transom. The upper housing of the drive unit includes a horizontal cylindrical portion one end of which is rotatably received in the transverse bore of the bracket assembly. A bracket assembly addition having a horizontal bore rotatably receives the opposite end of the upper housing cylindrical portion and is secured to the bracket assembly. Thus, the bracket assembly and the addition thereto serve to rotatably support the drive unit and provide for tilt movement of the unit on a horizontal transverse axis. The upper housing of the drive unit further includes a downwardly extending portion generally normal to the horizontal cylindrical portion. The lower housing of the drive unit is dirigibly connected to the downwardly extending portion of the upper housing for support and to provide for pivotal movement of the lower housing relative to the upper housing to provide for steering control of the watercraft.

DESCRIPTION OF THE DRAWING FIGURES

The drawings furnished herewith illustrate the best mode presently contemplated for carrying out the invention are are described hereinafter.

DESCRIPTION OF THE ILLUSTRATED EMBODIMENT

Figure 1:
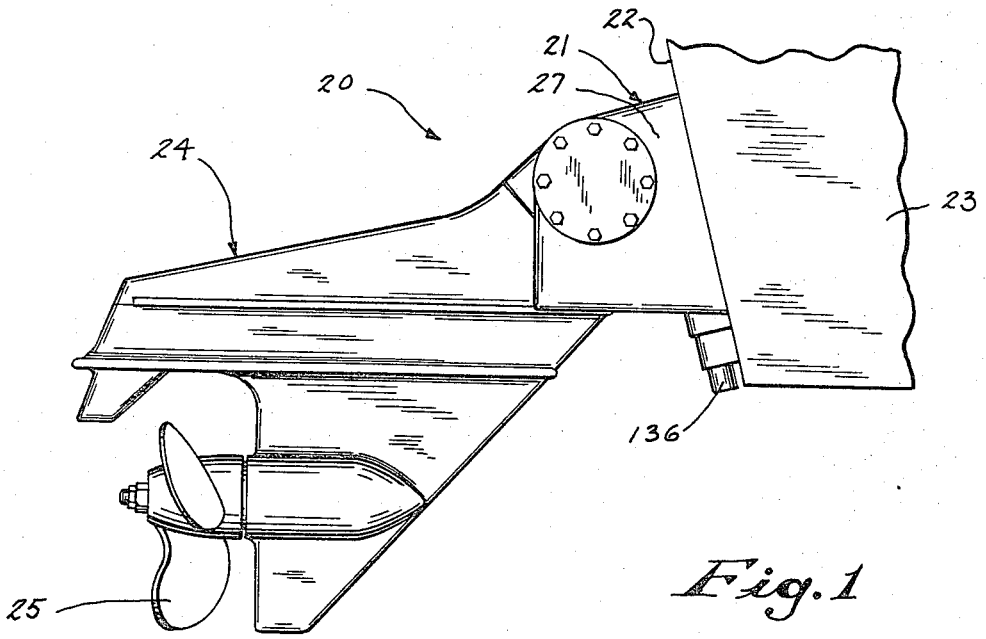
FIG. 1 is a side elevation of the stern drive assembly of this invention.
Figure 2:
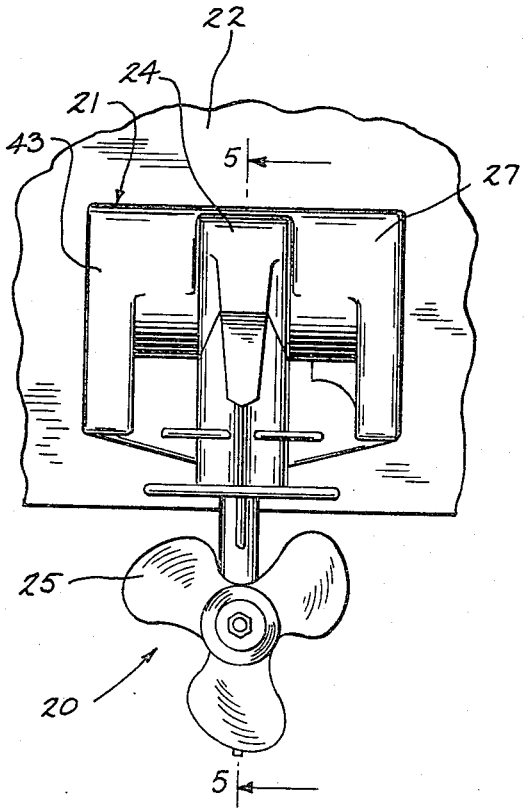
FIG. 2 is a rear elevation of the stern drive assembly of FIG. 1.
Figure 3:
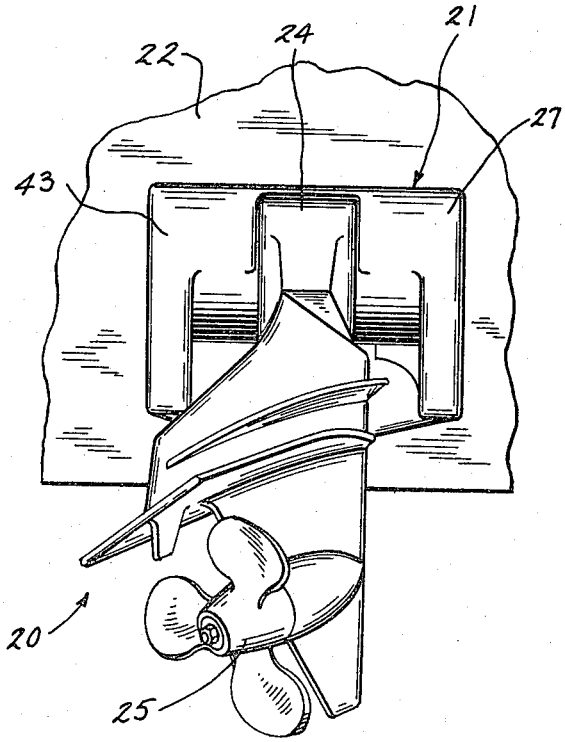
FIG. 3 is a view generally similar to that of FIG. 2 showing the steering mode of the stern drive unit for effecting a left turn of the watercraft.
Figure 4:
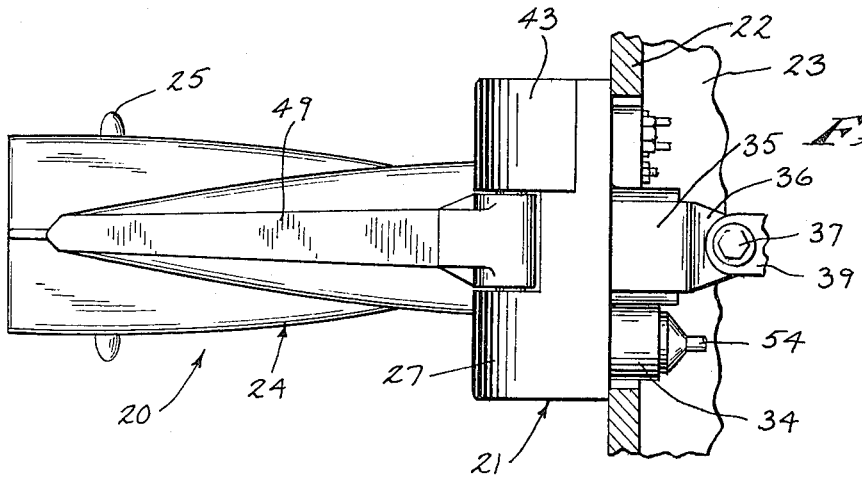
FIG. 4 is a plan view of the stern drive assembly.
Figure 9:
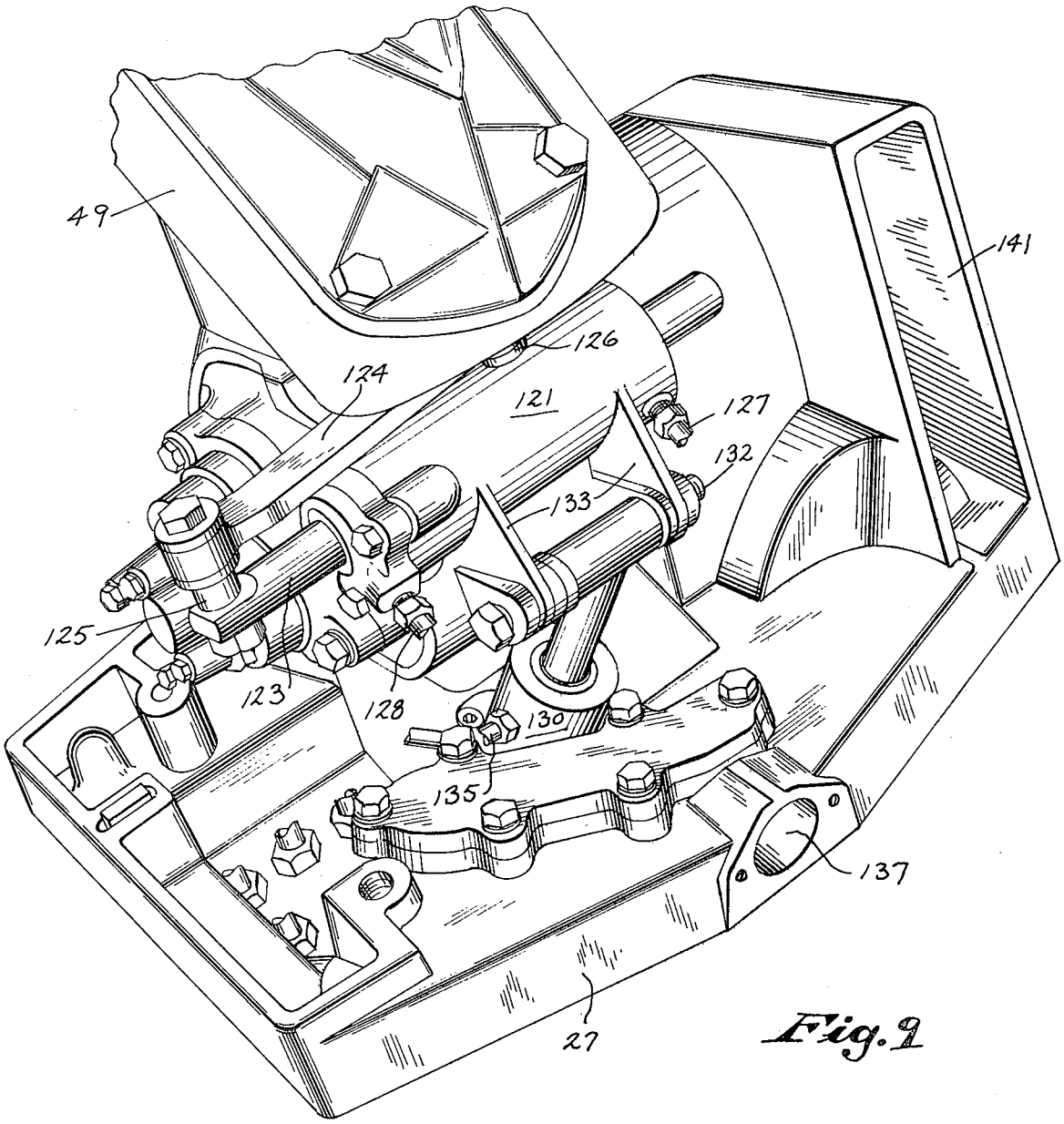
FIG. 9 is a partial perspective view of the assembly of the stern drive unit and outer transom plate as viewed from below the assembly.
Figure 5:
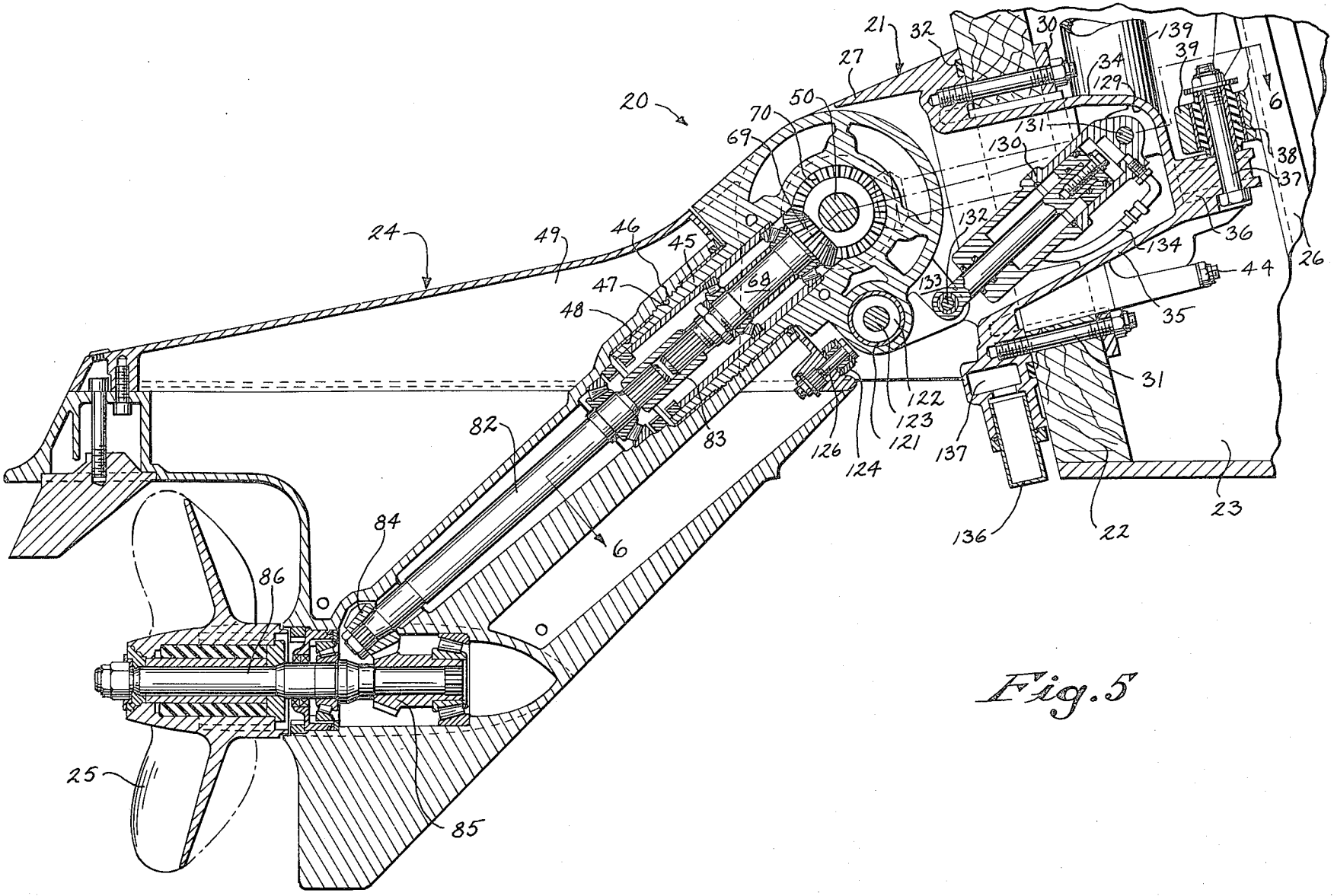
FIG. 5 is a sectional elevation of the stern drive assembly taken generally on line 5—5 of FIG. 2.

Referring to the drawings, the stern drive installation 20 generally includes a mounting assembly 21 for securement to the transom 22 of a partially shown watercraft 23 and the stern drive unit 24 carried by the mounting assembly. The drive unit 24 includes a propeller 25 rotatably carried at the lower end thereof and driven by an engine 26 mounted inboard of the watercraft 23.

The mounting assembly 21 comprises an outer transom bracket or plate 27 which has a generally rectangular peripheral mounting flange 28 adapted to engage with the outside of the transom 22 peripherally with respect to the transom opening 29. An annular, generally rectangular inner transom plate 30 generally surrounds the transom opening 29 interiorly of the watercraft 23 and a plurality of through bolts 31 extend through the plate 30 and transom 22 to engage with the outer transom plate 27 and thus mount the assembly 21 onto the watercraft. A sealing ring 32 is disposed in the annular groove 33 in the peripheral flange 28 of transom plate 27 and engages with the transom 22 in spaced relation from the opening 29 to preclude entry of water into the watercraft through the opening.

Intermediate the mounting flange 28, the outer transom plate 27 includes a central portion 34 that extends through the transom opening 29 toward the interior of the watercraft 23. As perhaps best shown in FIG. 6, the portion 34 is stepped and includes generally centrally thereof the projection 35 extending further into the interior of the watercraft 23 and providing an engine mount 36 for supporting the rear end of the engine 26. A bolt 37 secures the engine 26 onto the mount 36 and a rubber sleeve 38 in the mounting projection 39 from the engine substantially isolates the engine vibrations from the assembly 21 and the transom 22.

Exteriorly of the watercraft 23, the transom plate 27 further includes a bore 40 providing a cylindrical bearing support on a horizontal transverse axis for rotatably receiving one end of the upper cylindrical gear housing 41 of the drive unit 24. The opposite end of the cylindrical gear housing 41 is rotatably supported in the bore 42 axially aligned with the bore 40 and provided in the transom plate sector addition 43 secured to the plate 27 by a plurality of bolts 44 which extend rearwardly through the plate 27 to engage the addition. The transom plate 27 and its addition 43 transversely confine the housing 41 of the drive unit 24 and provide for the pivotal movement of the drive unit upon a generally horizontal axis to accommodate tilt movement and trim adjustment in a generally vertical plane.

An upper shaft housing 45 is formed integrally with the cylindrical housing 41 of the drive assembly 24 and projects normally and rearwardly therefrom. The rearward portion of housing 45 is cylindrical and includes an externally threaded portion at 46 for threadedly engaging with the internally threaded portion 47 in the bore 48 of the drive unit lower housing 49. The lower housing 49 is dirigible relative to the upper housing 45 at the threaded engagement therebetween to provide for steering control of the watercraft 23.

In the drive transmission for the stern drive assembly 24, a shaft 50 is rotatably supported generally co-axially within the upper cylindrical gear housing 41. A pair of spaced bevel reversing gears, a forward gear 51 and a reverse gear 52, are freely rotatable on the shaft 50. The gears 51 and 52 rotate oppositely as driven by the bevel gear 53 carried on the input shaft 54 disposed normal to the shaft 50 and rotatably supported in the through bore 55 of the transom plate 27. The shaft 54 is driven by the engine shaft, not shown, through the resilient coupling 56 therebetween.

The shaft 54 constitutes a part of a plug-in assembly 57 which can be assembled outside of the bore 55. In the assembly, a tapered roller bearing 58 is slipped onto the shaft 54 for disposition adjacent to the bevel gear 53. A second complementary tapered roller bearing 59 of opposed thrust is disposed on the shaft 54 and is spaced from the bearing 58 by a pair of radially spaced sleeves 60 and 61, with the sleeve 60 being disposed between the inner races of the bearings and the sleeve 61 between the outer races. To attain the proper pre-loading on the bearings according to specification, shimming, not shown, if necessary, may be interposed between the sleeve 61 and the outer races of either of the bearings. The proper pre-load condition on the bearings is applied by the nut 62 threaded onto the shaft 54 over the spring washer 63 in bearing relation with the inner race of the bearing 59.

The pre-loaded plug-in assembly 57 is inserted in the bore 55 with the external shoulder 64 on the outer sleeve 61 seating against the bore shoulder 65. If need be, shimming, not shown, may be disposed between the opposed shoulders 64 and 65 to properly set the assembly 57 relative to the centerline of the shaft 50. The assembly 57 is then secured in place by the cap member closure 66 secured by a plurality of bolts 67.

The output shaft 68 is transversely offset from the input shaft 54 and disposed in the shaft housing 45 and carries the bevel gear 69 at the upper end thereof for engagement with the bevel drive gear 70 carried on the horizontal shaft 50 in the housing 41. The shaft 68 comprises a part of the plug-in assembly 71 which like the assembly 57 can be assembled outside of its bore 72.

In the assembly 71, the tapered roller bearing 73 is slipped onto the output shaft 68 for disposition adjacent to the gear 69. An opposed thrust tapered roller bearing 74 is disposed on the shaft 68 and is spaced from the bearing 73 by a pair of radially spaced sleeves 75 and 76, with the sleeve 75 being disposed between the inner races of the bearings and the sleeve 76 disposed between the outer races of the bearings. The proper pre-load on the bearings according to specification is applied by the nut 77 threaded onto the shaft 68 and engaged over the spring washer 78 in bearing relation with the inner race of the bearing 74.

The pre-loaded plug-in assembly 71 is then inserted into the bore 72 with the outer sleeve 76 engaging the annular bore shoulder 79 to properly set the assembly relative to the horizontal shaft 50. The assembly 71 is then secured in place by the spacer sleeve 80 engaging with the adjacent end of sleeve 76 and retained by the externally threaded nut 81 threaded into the bore 72.

The shaft 82 of the dirigible lower unit 49 is drivingly coupled at the upper end thereof to the shaft 68 through a spline coupling 83 and carries the bevel gear 84 at the lower end thereof. The gear 84 meshes with the bevel gear 85 carried on the angularly related shaft 86 which mounts the propeller 25 rearwardly thereof.

The forward reversing gear 51 rotatable on the horizontal shaft 50 comprises a part of a pre-loaded plug-in assembly 87 disposed in the horizontal bore 88 of housing 41. A pair of opposed thrust tapered roller bearings 89 and 90 are disposed on the hub 91 of the gear 51 between the gear and the transversely spaced retaining washer 92. A spacer ring 93 is disposed between the inner races of the bearings 89 and 90. The outer races of the bearings 89 and 90 are disposed and retained within the sleeve 94. The assembly 87 is pre-loaded according to specification and held together by one or more screws 95 extending through the washer 92 and threadedly engaged in the end of the hub 91 of the gear 51.

Figure 6:
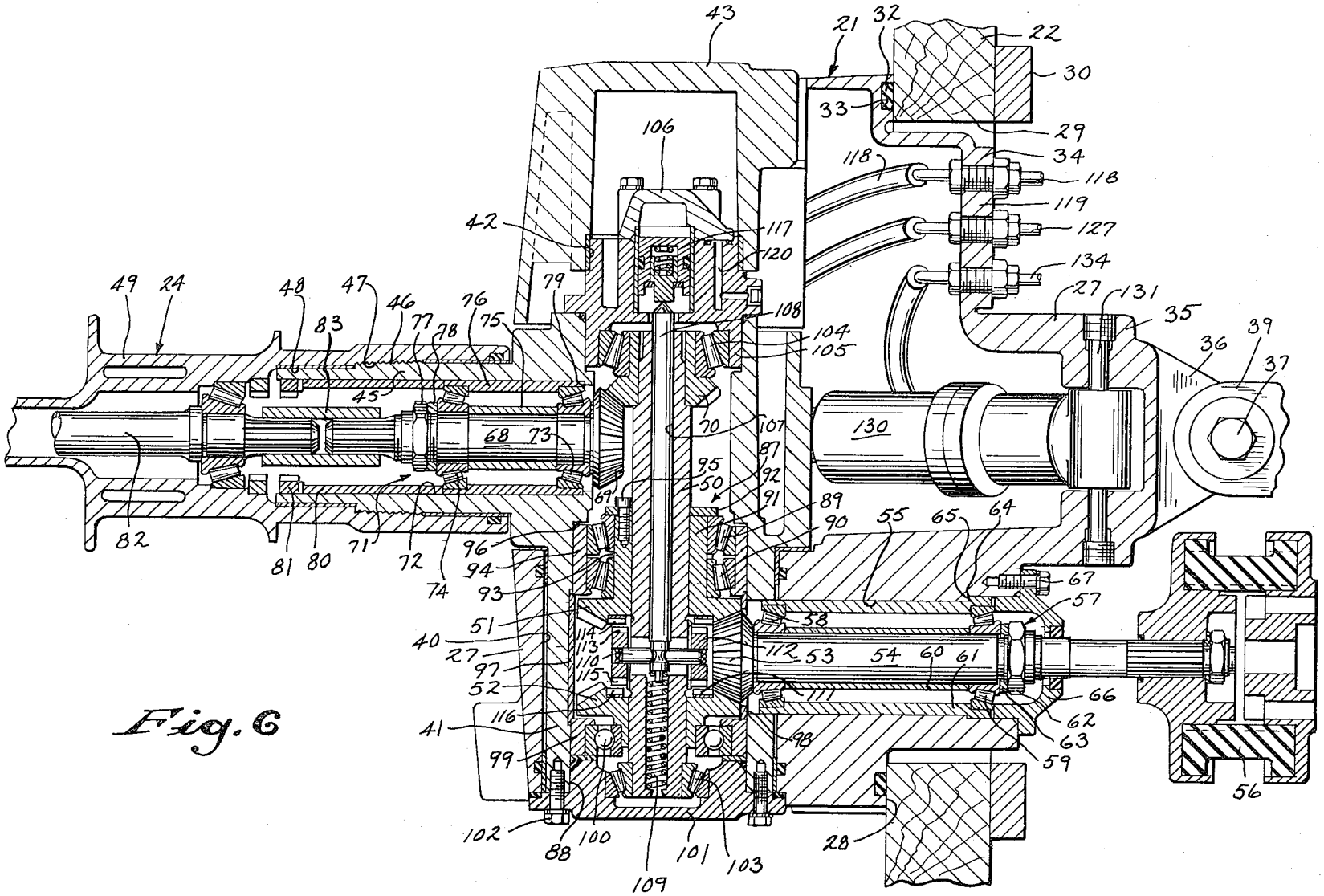
FIG. 6 is a sectional view taken generally on line 6—6 of FIG. 5.
Figure 7:
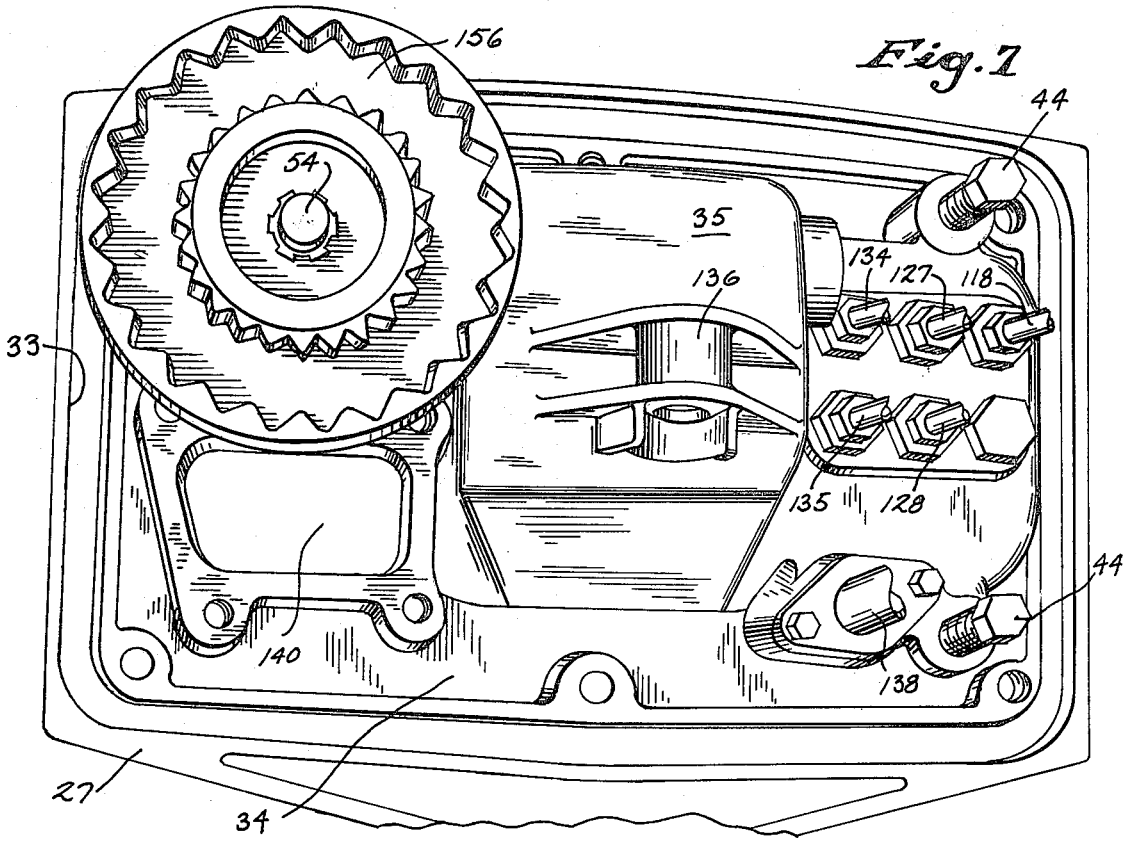
FIG. 7 is a perspective elevational view looking rearwardly at the forward face of the outer transom bracket.
Figure 8:
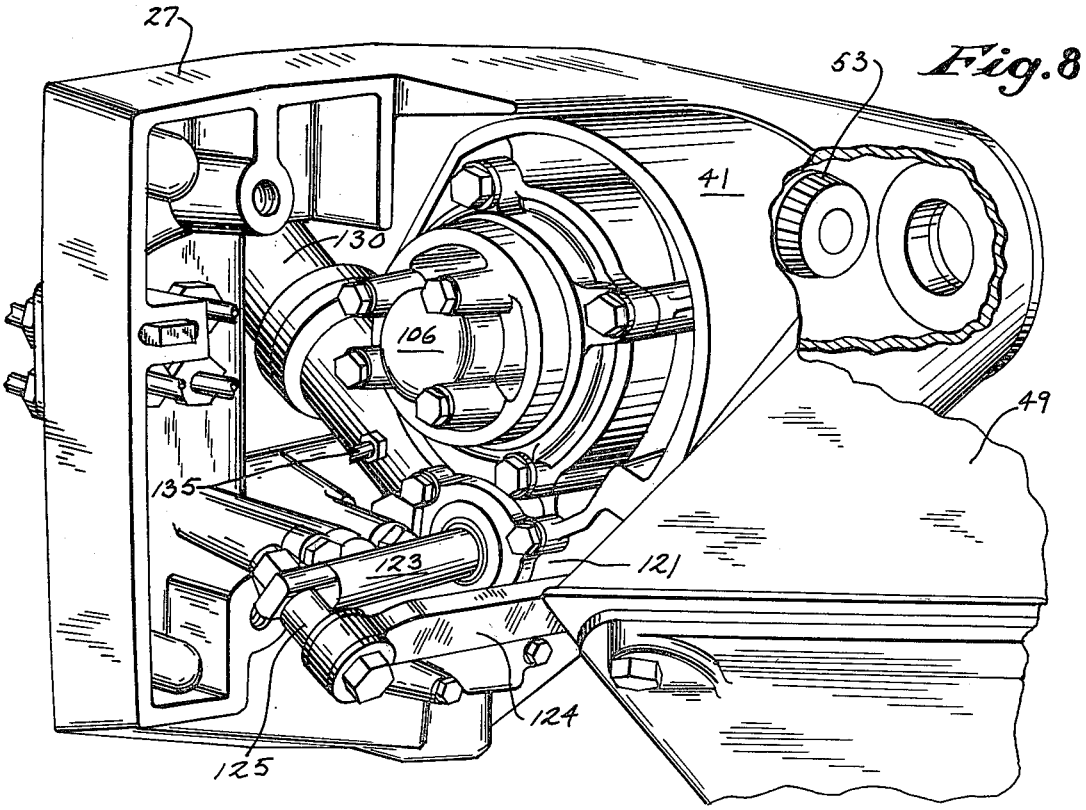
FIG. 8 is a partial perspective view with parts broken away and sectioned showing the assembly of the stern drive unit with the outer transom bracket.

The assembly 87 is inserted into the bore 88 from the right as viewed in FIG. 6 and engaged with the bore shoulder 96 to place the gear 51 in proper relation on the shaft 50. The assembly 87 is in turn held in place from the right by the spacer sleeve 97 provided with an opening 98 to provide insertion of the drive gear 53 of assembly 57, the collar 99 supporting the ball bearing 100 which in turn rotatably supports the reverse gear 52, and the end cap 101 which is secured to the cylindrical housing 41 by a plurality of bolts 102. As further shown in FIG. 6, the end cap 101 supports the tapered roller bearing 103 which in turn rotatably supports the right end of the horizontal shaft 50 in the bore 88.

The opposed end of horizontal shaft 50 along with the gear 69 carried thereon are rotatably supported by the tapered roller bearing 104 which is in turn supported by the axially extending flange 105 forming a part of the cylinder unit 106 which serves as a closure for the corresponding end of the bore 88.

The shaft 50 is hollow and the bore 107 therein carries an axially slidable pin 108 to the left and a compression spring 109 to the right as viewed in FIG. 6. Intermediate the pin 108 and the spring 109, the bore 107 slidably supports the cross-pin 110 for movement axially within the cross-slot 111 in the shaft 50. Cross-pin 110 carries the clutch element 112 having teeth 113 engageable with complementary teeth 114 on the forward gear 51 and opposed teeth 115 engageable with the complementary teeth 116 on the reverse gear 52.

The cylinder unit 106 contains a piston 117 slidable therein which is controlled by a master cylinder, not shown, convenient to the operator of the watercraft 23. The piston 117 responds by fluid displacement to manipulation of the master cylinder which communicates through an appropriate single line 118 through the hydraulic line mounting panel 119 provided in the outer transom plate 27 and through the tortuous passage 120 in the wall of the cylinder 106 with the head of the piston. As shown in FIG. 6, the piston 117 is displaced to the position wherein the pin 108 places the clutch element 112 in its neutral position intermediate to and out of contact with both reversing gears 51 and 52 such that the drive train to the propeller 25 remains inactive even while the drive gear 53 on the input shaft 54 drives the reversing gears on the shaft 50 in opposite directions. From its neutral position, the clutch element 112 is selectively movable into engagement with the reversing gears 51 and 52 to propel the watercraft 23 correspondingly. When the piston 117 is actuated to the right by an increase in pressure in the cylinder 106, the pin 108 moves correspondingly against the bias of spring 109 to move the clutch element 112 into meshing engagement with the reverse gear 52 and thus drivingly couple the shaft 50 to the reverse gear to provide for reverse drive of the propeller 25 to propel the watercraft 23 rearwardly. When the pressure in cylinder 106 is reduced by manipulation of the master cylinder from the position of the piston 117 in FIG. 6, the clutch element 112 and piston are moved correspondingly to the left under the bias of spring 109 to engage the clutch element with the forward gear 51 and thus couple the shaft 50 to the forward gear and provide for forward drive of the propeller 25 and forward propulsion of the watercraft 23.

To provide for steering control of the watercraft 23, a slave cylinder 121 is disposed beneath and generally parallels and is formed integrally with the upper cylindrical housing 41 of the stern drive unit 24. A piston 122 is slidably disposed in the cylinder 121 and has a rod 123 that projects oppositely therefrom and through the ends of the cylinder. A linkage member 124 extends between and is pivotally connected to the generally parallel pins 125 and 126 carried respectively at one end of the piston rod 123 and on the dirigible lower unit 49. Hydraulic lines 127 and 128 from opposed ends of a master cylinder, not shown, controlled by a steering wheel or the like, not shown, extend through the mounting panel 119 of transom plate 27 and are connected to the slave cylinder 121 on opposite sides of the piston 122. Through hydraulic lines 127 and 128, the slave cylinder 121 responds to the master cylinder to pivot the lower unit 49 and thus provide steering control for the watercraft 23.

The transom plate 27 is provided with a rearwardly opening cavity 129 behind the engine mounting projection 35 for receiving the trim adjustment cylinder-piston assembly 130. The cylinder-piston assembly 130 is disposed in the vertical plane of lower unit 49 and bridges the tilt axis with one end of the assembly 130 being pivotally mounted forwardly on the transverse pin 131 carried by the plate 27 and the other end thereof being pivotally mounted on the transverse pin 132 on the projection 133 from the housing 41. The assembly 130 is serviced by hydraulic lines 134 and 135 which extend through the mounting panel 119 of transom plate 27 for connection to opposite ends of the cylinder. The opposite ends of the lines 134 and 135 connect into an hydraulic system as generally shown in U.S. Pat. No. 3,888,203 whereby the cylinder-piston assembly 130 functions to adjust the trim of the drive unit 24 relative to the transom 22 of the watercraft 23 and to dissipate energy imparted to the drive unit upon striking some obstruction in the water.

Water for cooling the engine 26 is picked up by the pick-up 136 that projects downwardly beneath the watercraft 23 from the base of transom plate 27. The water coolant courses the passage 137 through the transom plate 27 and is carried to the engine 26 through the water line 138 extending from the interior face of the transom plate to the engine.

The transom plate 27 further provides for disposition of the exhaust products from engine 26. The engine exhaust is carried from engine 26 by the tube 139 which connects to the interior face of the transom plate 27 at the entrance to passage 140. The passage 140 communicates with the generally rectangular exhaust outlet 141 which opens downwardly at the side of the transom plate 27 exteriorly of the watercraft 23 to discharge the exhaust products adjacent to the surface of the water.

Various modes of carrying out the invention are contemplated as being within the scope of the following claims particularly pointing out and distinctly claiming the subject matter which is regarded as the invention.

I claim:

1. In a stern drive mechanism for watercraft, a mounting bracket assembly for securement to the transom of a watercraft, said bracket assembly having a horizontal transverse bore therein rearwardly with respect to the transom, a drive unit having an upper housing and a lower housing, said upper housing including a horizontal cylindrical portion with one end of the cylindrical portion being rotatably received in the bore of the bracket assembly, and a bracket assembly addition having a horizontal bore for rotatably receiving the opposite end of the cylindrical portion and being secured to the bracket assembly, said bracket assembly and the addition thereto serving to rotatably support the drive unit and providing for tilt movement of said unit on a horizontal transverse axis relative to the transom, said upper housing further including a downwardly extending portion generally normal to the horizontal cylindrical portion, said downwardly extending portion of said upper housing and said lower housing being telescoped one within the other and being threadedly engaged to provide a dirigible connection therebetween for support of the lower housing and to provide for pivotal movement of the lower housing relative to the upper housing whereby to provide for steering control of the watercraft.

2. The construction of claim 1 wherein the drive unit is powered by an inboard engine and the engine exhaust products are conducted from the engine to passage means in the mounting bracket assembly, said passage means having a downwardly opening outlet rearwardly of the transom for discharge of the exhaust products.

3. The construction of claim 1 wherein the drive unit is powered by an inboard engine and the engine is water cooled, and a water pick-up is provided on the mounting bracket assembly and communicates with the engine.

4. The construction of claim 1 wherein a transversely extending cylinder is carried by the upper housing of the drive unit and a piston is disposed in the cylinder and has a rod extending therefrom through the end of the cylinder, and linkage means extend between and are pivotally connected to the piston rod and lower housing, respectively, said piston being hydraulically movable within the cylinder to pivot the lower housing relative to the upper housing for steering control.

5. The construction of claim 1 wherein a cylinder-piston assembly is disposed in the vertical plane of the drive unit and is connected between the mounting bracket assembly and the upper housing of the drive unit, said cylinder-piston assembly providing for the dissipation of energy during tilt movement of the drive unit due to impact with an obstruction and to adjust the trim of the drive unit relative to the transom of the watercraft.

6. The construction of claim 1 wherein the downwardly extending portion of the upper housing is generally cylindrical and provided with threads externally, and the upper end of the lower housing is provided with a bore having complementary threads internally, said lower housing being threadedly engaged upon the downwardly extending portion of the upper housing.

7. The construction of claim 1 wherein the cylindrical portion of the upper housing comprises a gear housing having reversing gears including a reverse gear and a forward gear freely rotatable on a shaft supported coaxially with the tilt axis, and clutch means on said shaft intermediate the reversing gears.

8. The construction of claim 7 wherein the shaft is hollow to provide a bore therein, a pin slidably disposed in said bore and engaging one side of said clutch means, spring means disposed in said bore and engaging the opposite side of the clutch means, said clutch means having a neutral position intermediate the reversing gears, means to actuate the pin against the bias of the spring means and thereby move the clutch means from the neutral position to engage with the reverse gear and effect rotation of the shaft correspondingly, the bias of the spring means being effective to move the clutch means from the neutral position to engage with the forward gear for corresponding shaft rotation when the pin actuation means are rendered ineffective.

9. The construction of claim 7 wherein the reversing gear shaft carries a drive gear, and an output shaft is rotatably disposed in the aligned bores of the depending portion of the upper housing and the lower housing and carries a driven gear engageable with said drive gear on the reversing gear shaft, said output shaft being axially extendible to accommodate the steering movements of the lower housing.

10. In propulsion apparatus for a watercraft, a drive unit, support means for the drive unit carried by the watercraft, said drive unit being pivotally mounted by the support means for tilt movement of the unit about a horizontal transverse axis and including upper and lower housings, said housings being telescoped one within the other and being threadedly engaged to provide a dirigible connection therebetween on a generally vertical axis for steering the watercraft.

11. In the structure according to claim 10 wherein the drive unit is a stern drive unit.

12. In the structure according to claim 10 wherein a shaft is rotatably supported in the drive unit housings and is axially extendible to accommodate the threaded dirigible connection between the housings.

13. In the structure according to claim 10 wherein the upper housing telescopes into the lower housing of the drive unit.

* * * * *